US005554052A

United States Patent [19]

Saijo et al.

[11] Patent Number: 5,554,052

[45] Date of Patent: Sep. 10, 1996

[54] LOCKING CONNECTOR

[75] Inventors: Eiji Saijo; Keigo Atsumi; Masahiko Aoyama, all of Yokkaichi, Japan

[73] Assignee: Sumitomo Wiring Systems, Ltd., Japan

[21] Appl. No.: 351,503

[22] Filed: Dec. 7, 1994

[30] Foreign Application Priority Data

Dec. 7, 1993 [JP] Japan ..... 5-071579 U

[51] Int. Cl.[6] ..... H01R 13/40

[52] U.S. Cl. ..... 439/595; 439/352; 439/752.5

[58] Field of Search ..... 439/595, 598, 439/752, 352, 733

[56] References Cited

U.S. PATENT DOCUMENTS

| | | | |
|---|---|---|---|
| 4,867,711 | 9/1989 | Yuasa | 439/752 |
| 5,232,373 | 8/1993 | Sawada | 439/595 |
| 5,238,411 | 8/1993 | Jinno et al. | 439/595 |
| 5,240,434 | 8/1993 | Yagi et al. | 439/595 |
| 5,316,504 | 5/1994 | Jinno | 439/595 |
| 5,378,170 | 1/1995 | Abe et al. | 439/595 |

FOREIGN PATENT DOCUMENTS

| | | | |
|---|---|---|---|
| 0727935 | 4/1980 | U.S.S.R. | 439/352 |

*Primary Examiner*—P. Austin Bradley
*Assistant Examiner*—Jill DeMello
*Attorney, Agent, or Firm*—Jordan B. Bierman; Bierman and Muserlian

[57] ABSTRACT

An engaging member including a reinforcing projection and a cut-out portion. A recess complementary to the reinforcing projection is formed in the inner wall of the deflection space which receives the engaging member when it is deflected. When the engaging member is deflected by the terminal, the reinforcing projection fits into the recess. Excessive deflection of the engaging member is prevented by the contact of the surface of the cut-out portion with the inner wall of the deflection space. The strength of the engaging member is assured by the presence of the reinforcing projection. Since sufficient deflection room for the engaging member is provided by both the deflection space and the recess, the thickness of the deflection space can be made smaller than in prior art connectors by the depth of the recess.

10 Claims, 3 Drawing Sheets

LOCKING CONNECTOR

This application claims the benefit of the priority of Japanese Application 5/71579, filed Dec. 7, 1993.

This Invention relates to a connector formed with an engaging member for locking in a terminal fitting.

BACKGROUND OF THE INVENTION

A connector of this kind shown in FIG. 6. Connector 50 has housing 51 of resin which is formed with two cavities 52 spaced apart vertically from each other. Engaging member 53 is formed integrally with the inner wall which defines each cavity 52 at the bottom, each engaging member 53 projecting toward a leading end (to the left in FIG. 6) and being supported at a base end only. A deflection space 55 formed below each cavity 52 for permitting the downward (i.e. in a direction transverse to the insertion direction of the terminal fittings) elastic deflection of engaging member 53.

While a terminal fitting 60 is inserted into the cavity 52 of the connector 50, the bottom surface of the terminal fitting 60 comes into contact with a projection 54 of the engaging member 53, thereby deflecting the engaging member 53 downward into the deflection space 55 as shown in the lower cavity in FIG. 6. When the terminal fitting 60 is completely inserted to reach a proper position as shown in the upper cavity in FIG. 6 and an unillustrated recess formed in the bottom surface of the terminal fitting 60 reaches a position corresponding to the projection 54 of the engaging member 53, the engaging member 53 moves upward due to its elastic restoring force, causing the projection 54 to be fitted in the recess of the terminal fitting 60. The terminal fitting 60 is lockingly held at the proper position in the cavity 52 by the engagement of the projection 54 with the recess.

In the prior art connector 50, in order to assure a sufficient margin for permitting the deflection of the engaging member 53, the dimension of the deflection space 55 in the deflecting direction of the engaging member 53 (vertically in FIG. 6) is set equal to or larger than the amount of movement of its leading end 53*a* resulting from the deflection of the engaging member 53.

When the terminal fitting 60 is to be removed from the cavity 52, a disengaging tool is inserted into the deflection space 55 to catch and pull down the engaging member 53 toward the deflection space 55, thereby disengaging the projection 54 of the engaging member 53 from the recess of the terminal fitting 60. If the disengaging tool is wrongly operated so that the engaging member 53 is excessively deflected during this removal, the engaging member 53 may undergo plastic deformation or, in worse cases, may be bent or broken. In order to avoid such an event, a wall portion 56 having a given thickness to assure the required strength is formed at the bottom of the deflection space 55. Excessive deflection of the engaging member 53 is prevented by causing the leading end 53*a* of the engaging member 53 to come into contact with the inner surface of the wall portion 56.

In some cases, the connector 50 is required to have a small size by reducing the dimensions thereof in the arranging direction of the cavities 52. However, the cavities 52, the deflection space 55 and the wall portion 56 need to have predetermined minimum dimensions, thus there is a limit in reducing these dimensions. As a method for reducing the size of the connector, consideration can be given to making engaging member 53 thinner. However, this is not preferable because the strength of the engaging member 53 would be reduced.

An object of the Invention is to provide a connector of smaller size which is, nevertheless, capable of preventing excessive deflection of an engaging member while assuring sufficient deflection margin and strength of the engaging member and the wall portion.

SUMMARY OF THE INVENTION

The Invention is directed to a connector comprising a housing formed preferably with a plurality of cavities into which terminal fittings are to be inserted, an engaging member which is lockingly engaged with the corresponding terminal fitting, and a deflection space for permitting the engaging member to be deflected in a direction transverse to the direction of insertion of the terminal fitting. At least one notch portion is formed in the engaging member to provide a reinforcing projection which projects toward the deflection space and a recess into which the reinforcing projection is to be fitted is formed in an inner wall of the deflection space.

DETAILED DESCRIPTION OF THE INVENTION

According to the Invention, by providing a reinforcing projection on the engaging member and another corresponding recess in the inner wall of the housing, the deflection space is enlarged in the deflection direction. Namely, the reinforcing projection deflects into the corresponding recess in the inner wall of the housing. Thereby, the deflection space is enlarged without excessively influencing the strength of the engaging member. The shape of the recess can be chosen freely as long as the recesses correspond to the projections to provide an enlarged deflection space (the recess in the inner wall must be the same as or larger than the projection), so that the engaging member and the inner wall have sufficient strength.

If the inner wall is the wall separating the two cavities, it is preferred to provide the recess portion in the inner wall as a through hole. In this way, the entire thickness of the inner wall can be used to enlarge the deflection space. In other words, the recess formed in the engaging member can be made as small as possible in order to maximize the strength of the engaging member.

In a preferred form of the connector, the notch portion is formed to have a slanting surface which comes into contact with the inner wall of the deflection space when the engaging member is deflected, thereby to cause the reinforcing projection to fit into the recess.

According to the Invention, when the engaging member is deflected, its reinforcing projection fits into the recess and the notch portion approaches the inner wall of the deflection space. The provision of the recess assures a sufficient deflection margin of the engaging member and the reinforcing projection assures the strength of the engaging member itself. Further, excessive deflection of the engaging member is prevented by the contact of the notch portion with the inner wall of the deflection space and/or by the contact of the reinforcing projection with the inner bottom surface of the recess.

Since the recess is formed in the inner wall of the deflection space to provide a sufficient deflection margin and the reinforcing projection is fitted in this recess, the dimensions of the deflection space can be smaller in the deflecting direction of the engaging member than the actual deflecting amount of the engaging member.

Moreover, the slanting surface of the notch portion comes into contact with the inner wall of the deflection space thereby to prevent an excessive deflection of the engaging member. Preferably, the slanting surface comes fully into contact with the inner wall of the housing so that the amount of material to be removed to form the projection can be minimized.

According to the present Invention, the dimensions of the deflection space can be made smaller than the deflecting amount of the engaging member while assuring sufficient deflection margin and strength of the engaging member, and preventing excessive deflection thereof. Since the necessary dimensions of the inventive connector can be smaller than those of the prior art connectors which require a deflection space whose dimension corresponds to the deflecting amount of the engaging member, the inventive connector can be fabricated smaller than the prior art connectors. Further, to prevent excessive deflection of the engaging member, the slanting surface of the notch portion formed in the engaging member is brought into contact with the inner wall of the deflection space. Accordingly, unlike the prior art where the engaging member comes into contact with the inner wall of the deflection space means at a point or along a line only, the pressing force of the engaging member is not concentrated at a specific position of the inner wall of the inventive connector. This obviates the need to increase the strength of the inner wall itself in order to avoid the deformation of and the damage to the inner wall, and allows the inner wall to be made thinner. Thus, the connector can be fabricated even smaller. Hereafter, one specific embodiment of the inventive device is described with reference to the accompanying drawings, in which:

DETAILED DESCRIPTION OF THE DRAWINGS

Figure 1:
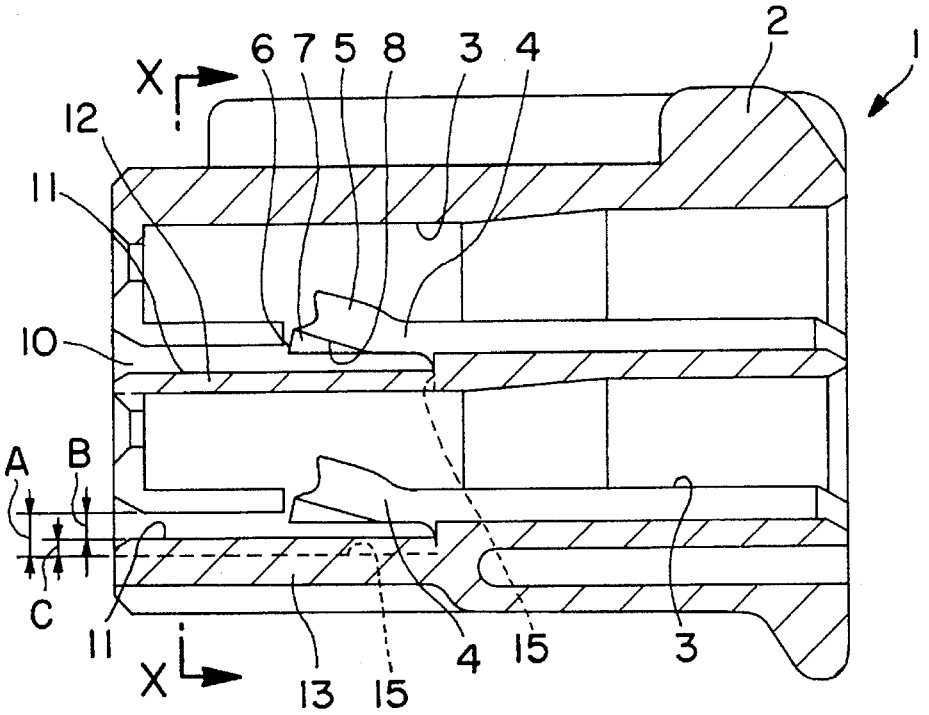
FIG. 1 is a sectional view showing one embodiment of the Invention.

A connector 1 according to this embodiment includes a housing 2 of resin. The housing 2 is formed with cavities 3 arranged at two stages in vertical relationship as shown in FIGS. 1 to 5. A plurality of cavities 3 are formed parallel to one another in each stage. An engaging member 4 is formed integrally with the bottom inner wall defining each cavity 3. The engaging member 4 projects toward a leading end (toward the left in FIGS. 1 and 2) and is supported only at the opposite base end, its leading end being elastically deformable in the vertical direction.

Figure 2:
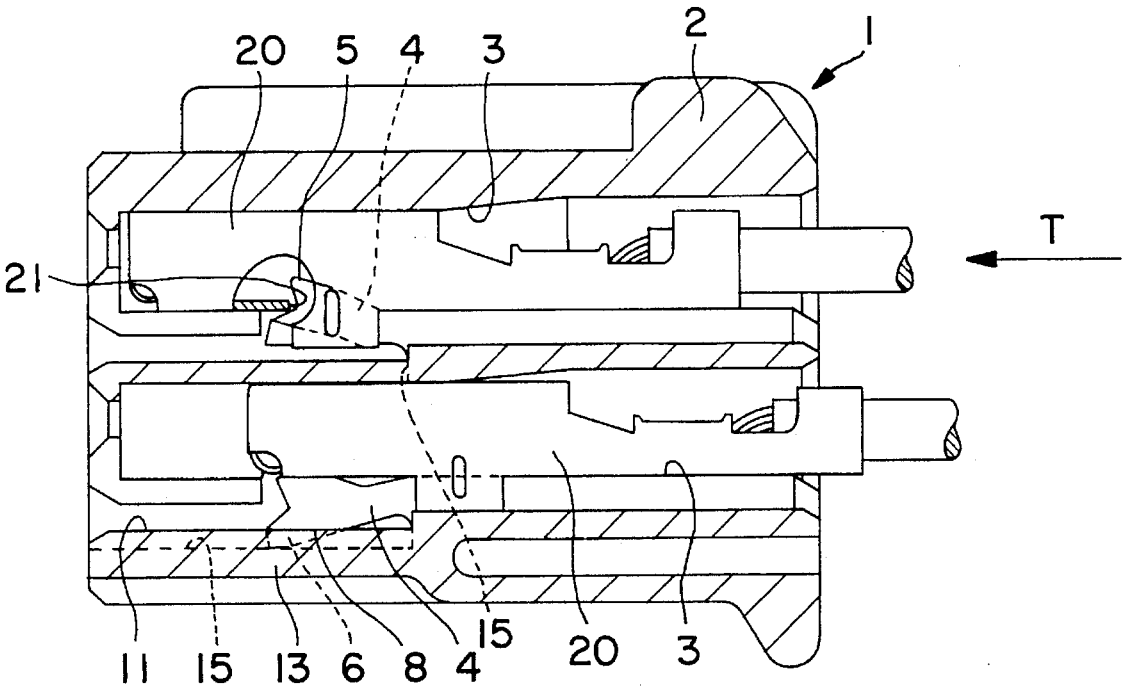
FIG. 2 is a sectional view similar to FIG. 1, with terminal fittings being inserted.
Figure 3:
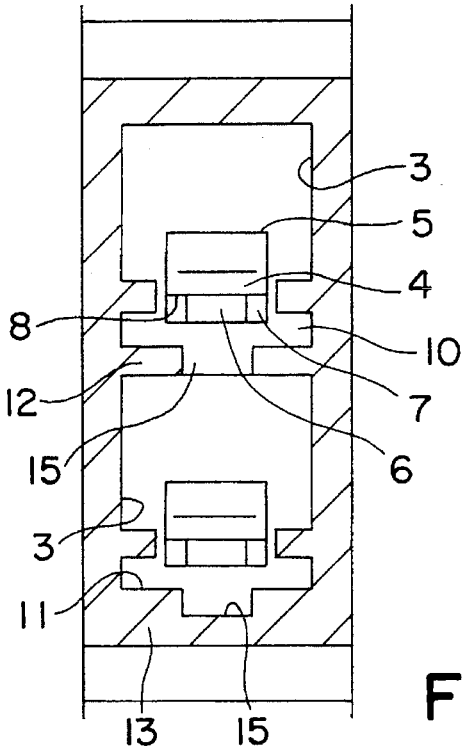
FIG. 3 is a sectional view taken along the line X—X of FIG. 1.
Figure 4:
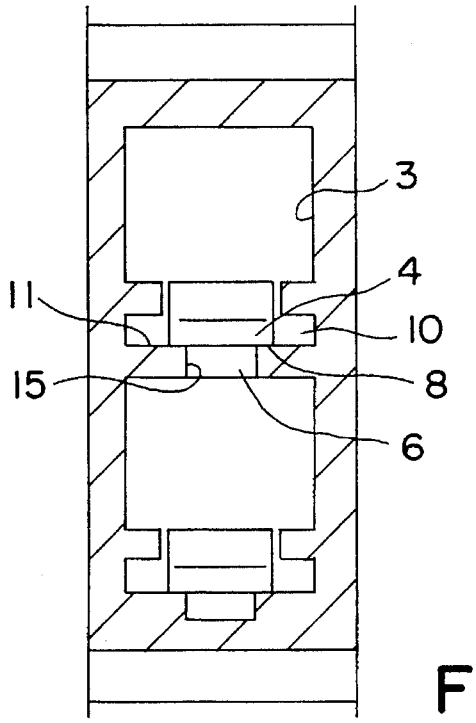
FIG. 4 is a sectional view wherein the engaging members are deflected.
Figure 5:
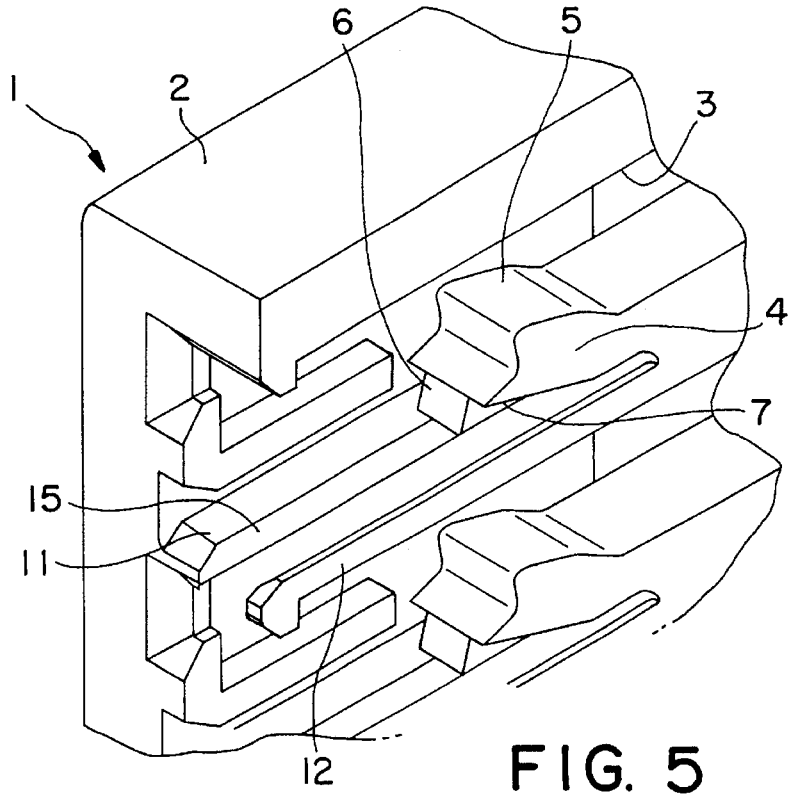
FIG. 5 is a perspective view in section of the inventive connector.
Figure 6:
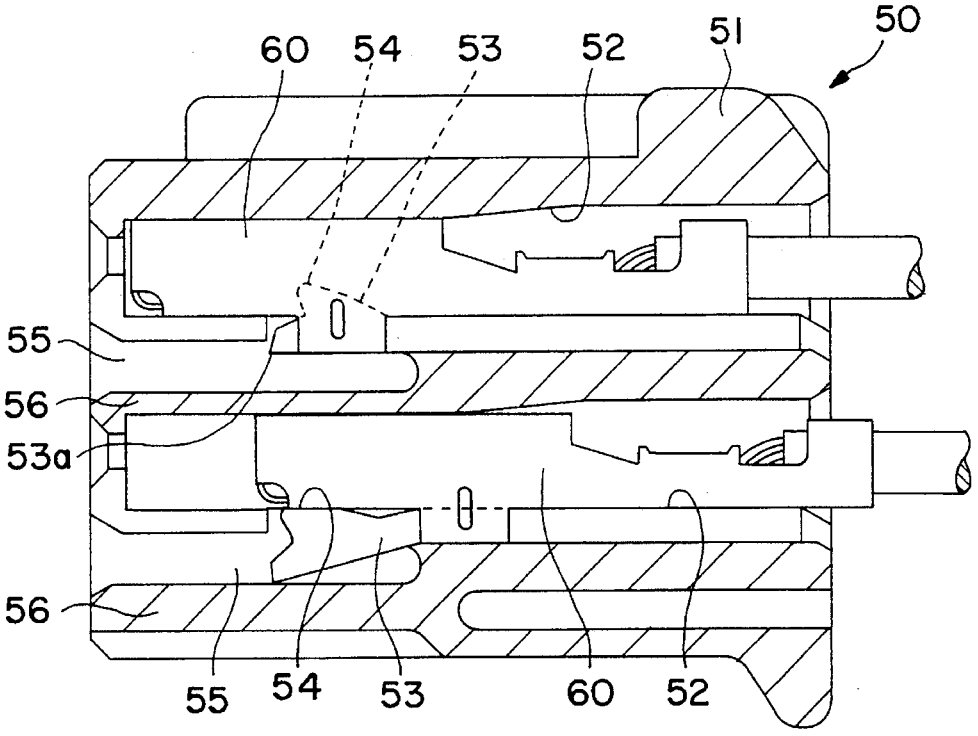
FIG. 6 PRIOR ART
FIG. 6 is a sectional view showing a prior art device.

As shown in FIG. 2, a terminal fitting 20 is insertable into the cavity 3. At an intermediate stage, while the terminal fitting 20 is being inserted into the cavity 3, the lower surface of the terminal fitting 20 comes into contact with a projection 5 on the leading end of the engaging member 4; the projection 5 projects into the cavity 3 and presses the engaging member 4 downward. When the terminal fitting 20 is completely inserted into the connector, an opening 21, formed in the lower surface of the terminal fitting 20 and located above the projection 5, receives the leading end of the engaging member 4 which moves upward due to its restoring force. Upon upward movement of the leading end of the engaging member 4, the projection 5 enters opening 21 and engages a leading edge thereof. By this engagement by projection 5 of opening 21, the terminal fitting 20 is locked in the proper position in the cavity 3.

The thickness of the engaging member 4 in this embodiment, i.e. the distance between the upper and lower surfaces thereof, is large because of the presence of the projection 5. This large thickness assures the required strength and rigidity of the engaging member 4. In a free state, where the projection 5 projects into the cavity 3, the lower surface of the engaging member 4 is substantially parallel to a partition wall 12 located immediately below. Corner portions at opposite sides are cut away in the bottom part of the engaging member 4, leaving a reinforcing projection 6 which is centered with respect to the widthwise direction (lateral direction in FIGS. 3 and 4). The cut away corner portions at the opposite sides are notch portions 7. A contact surface 8 of each notch portion 7, which is a downward facing surface, is inclined downward from a leading end to a rear end. The rear end of the contact surface 8 is continuous with the lower surface of the engaging member 4.

In the housing 2 is formed a deflection space 10 which extends from the front end face of the housing 2 (left side in FIGS. 1 and 2) to a position below the base end of the engaging member 4. The deflection space 10 communicates with the corresponding cavity 3. The partition wall 12 between the deflection space 10 at the upper stage and the cavity 3 at the lower stage acts as a lower inner wall 11 defining the deflection space 10 which communicates with the cavity 3 at the upper stage. A bottom wall 13 of the housing 2 acts as a lower inner wall 11 defining the deflection space 10 which communicates with the cavity 3 at the lower stage.

A recess 15 for assuring a sufficient deflection margin of the engaging member 4 is formed in the inner wall 11 of each deflection space 10 to correspond with the reinforcing projection 6. The recess 15 of the deflection space 10 at the upper stage is an open-bottom groove formed in the partition wall 12 of such a width that the reinforcing projection 6 can fit therein; the recess 15 also communicates with the cavity 3 at the lower stage. The recess 15 of the deflection space 10 at the lower stage is a closed-bottom groove formed in the bottom wall 13 of such a width that the reinforcing projection 6 fits therein. A dimension A is a sum of a dimension B, between the lower surface of the engaging member 4 in its undeflected position and the inner wall 11 of the deflection space 10, and a dimension C, which is the depth of the recess 15. The dimension A is slightly larger than the distance which the leading end of the engaging member 4 is to be shifted in the vertical direction from its undeflected position to its deflected state when it is pressed downward by the lower surface of the terminal fitting 20. Thus, the engaging member 4 is permitted to be deflected sufficiently so as not to hinder the insertion of the terminal fitting.

Further, the contact surfaces 8 of the notch portions 7 are in conformity with surface portions of the inner wall 11 at opposite sides of the recess 15. When the engaging member 4 is pressed downward by the terminal fitting 20 thereby to be deflected, the substantially entire contact surfaces 8 come into contact with the inner wall 11.

While being pressed downward by the lower surface of the terminal fitting 20 during the insertion of the terminal fitting 20 into the cavity 3, the engaging member 4 is permitted to be deflected by the reinforcing projection 6 entering the recess 15. Since the engaging member 4 is deflected sufficiently so that the projection 5 thereof is out of the cavity 3, the terminal fitting 20 can be smoothly inserted into the proper position without excessive friction with the projection 5.

In removing the terminal fitting 20 locked in the cavity 3, the leading end of an unillustrated disengaging tool is inserted into the deflection space 10 from the front end face of the housing 2 to catch and pull down the leading end of the engaging member 4. In this state, the terminal fitting 20 is removed from the cavity 3. Even if a strong force is exerted by the disengaging tool to pull down the engaging member 4, an excessive deflection of the engaging member 4 can be prevented by the contact of the contact surfaces 8 of the notch portions 7 with the inner wall 11 of the deflection space 10. Thus, the engaging member 4 is safeguarded from plastic deformation, bending, and damage resulting from excessive deflection.

As described above, in the connector 1 of this embodiment, the sufficient deflection margin of the engaging member 4 is assured by the vertical dimension of the deflection space 10 and the depth of the recess 15 formed in the inner wall 11. The vertical dimension of the deflection space 10 can be made smaller by the depth of the recess 15, compared with the prior art connectors in which the sufficient deflection margin of the engaging member 4 is assured only by the deflection space. Thus, the connector 1 can be fabricated smaller by reducing the vertical dimension thereof.

Particularly, in this embodiment, the contact surfaces 8 of the notch portions 7 of the engaging member 4 are in contact with the inner wall 11 of the deflection space 10 over a large area. Thus, unlike the case in the prior art where the engaging member 4 comes into contact with the inner wall only over a small area at its leading end, a pressing force rendered from the engaging member 4 is not concentrated at a specified position of the partition wall 12. This obviates the need to excessively increase the strength of the partition wall 12 in order to avoid deformation and damage; accordingly the partition wall 12 can be made thinner. This also contributes to a smaller vertical dimension of the connector 1.

The smaller vertical dimension of the connector 1 leads neither to an insufficient deflection margin of the engaging member 4 nor to the inability to prevent an excessive deflection of the engaging member 4. The sufficient deflection margin of the engaging member 4 is provided and the excessive deflection thereof is securely prevented. Further, the strength and rigidity of the engaging member 4 itself is assured by the presence of the reinforcing projection 6 which is thick in the vertical direction.

The present device is not limited to the foregoing embodiment, but may be embodied in other modified devices.

a) Although the foregoing embodiment is described with respect to the case where the cavities 3 are arranged at two stages, the present device can be applied to a connector in which the cavities 3 are arranged at three or more stages.

b) The contact surfaces 8 of the notch portions come into contact with the inner wall 11 of the deflection space 10 to prevent an excessive deflection of the engaging member 4 in the foregoing embodiment. However, the arrangement may, according to the present Invention, be such that a bottom end face of the reinforcing projection 6 comes into contact with the inner surface of the bottom recess 15 for the same purpose.

Furthermore, the present device is not limited to the embodiments described and shown in the drawings, but may be embodied in several forms without departing from the spirit and scope thereof. It is, therefore, to be broadly construed and not to be limited except by the character of the claims appended hereto.

What we claim is:

1. A connector comprising a housing containing at least one cavity adapted to receive a terminal fitting, an engaging member having a first position, wherein said engaging member projects into said cavity, and a second position, wherein said engaging member is deflected in a deflection direction into a deflection space, by said terminal fitting as said fitting is inserted in an insertion direction into said cavity, said deflection space being adjacent to, and in communication with, said cavity, a reinforcing projection on a face of said engaging member and extending in said deflection direction, said reinforcing projection being defined by at least one cut-out portion on said engaging member and having a cut-out surface, a recess in an inner wall of said housing adjacent said reinforcing projection, said recess being adapted to receive said projection when said engaging member is in said second position.

2. The connector of claim 1 wherein there is a plurality of cavities.

3. The connector of claim 1 wherein there are two cut-out portions, one on either side of said projection.

4. The connector of claim 1 wherein said cut-out surface is adjacent said inner wall when said engaging member is in said second position.

5. The connector of claim 1 wherein said projection has a reinforcing surface at an end of said projection in said deflection direction, said reinforcing surface being in said recess when said engaging member is in said second position.

6. The connector of claim 1 wherein there are two cavities adjacent each other with a separator wall therebetween, said recess comprising an opening in said separator wall extending through said separator wall and adapted to receive said projection when said engaging member is in said second position.

7. The connector of claim 1 wherein there is a niche in said terminal fitting adapted to receive said engaging member when said terminal fitting is in a position in which it extends completely into said cavity.

8. The connector of claim 1 wherein said cut-out surface slants towards lower surface of said engaging member in a slant direction opposite to said insertion direction, so that, when said engaging surface is in said second position, said cut-out surface is adjacent and substantially parallel to said inner wall.

9. The connector of claim 8 wherein substantially all of said cut-out surface is in contact with said inner wall when said engaging member is in said second position.

10. The connector of claim 9 wherein said projection has a reinforcing surface at an end of said projection in said deflection direction, substantially all of said reinforcing surface being in contact with said inner wall when said engaging member is in said second position.

* * * * *